US006944979B2

(12) United States Patent
Hanafusa et al.

(10) Patent No.: US 6,944,979 B2
(45) Date of Patent: Sep. 20, 2005

(54) SNOW REMOVING MACHINE

(75) Inventors: Jitsumi Hanafusa, Wako (JP); Kenji Kuroiwa, Wako (JP); Takashi Ikeda, Wako (JP); Masatoshi Nagaoka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/919,967

(22) Filed: Aug. 17, 2004

(65) Prior Publication Data

US 2005/0039353 A1 Feb. 24, 2005

(30) Foreign Application Priority Data

Aug. 21, 2003 (JP) ..... 2003-298015
Aug. 21, 2003 (JP) ..... 2003-298020

(51) Int. Cl.[7] ..... E01H 5/08
(52) U.S. Cl. ..... 37/260
(58) Field of Search ..... 637/196, 197, 637/244–262

(56) References Cited

U.S. PATENT DOCUMENTS

2001/0014569 A1 * 8/2001 Baker ..... 446/448

FOREIGN PATENT DOCUMENTS

| | | | |
|---|---|---|---|
| JP | 02136122 | | 11/1990 |
| JP | 7-291289 | * | 7/1995 |
| JP | 00080621 | | 3/2000 |

* cited by examiner

*Primary Examiner*—Christopher J. Novosad
(74) *Attorney, Agent, or Firm*—Adams & Wilks

(57) ABSTRACT

A snow removing machine which throws up snow collected by an auger with a blower and throws out the snow via a chute is provided. The chute is placed on a blower housing enclosing the blower. The chute is placed on the right or left of the blower housing in a body width direction, so as to receive snow thrown up by centrifugal force of the blower. In a dead space on the opposite side to the chute, a control unit for controlling rotations of electric motors and so on and a battery for supplying power to the electric motors are disposed.

10 Claims, 13 Drawing Sheets

SNOW REMOVING MACHINE

FIELD OF THE INVENTION

The present invention relates generally to a snow removing machine and, more particularly, to a snow removing machine having, on the right and left of the body, travel devices propelled by battery-power-driven electric motors, and having, at the front, a working device including an auger and a blower.

BACKGROUND OF THE INVENTION

A snow removing machine which collects snow by an auger, throws up the collected snow by a blower, and throws out the thrown-up snow by a chute is known. In particular, a snow removing machine having a battery for supplying power to electrical components and a control unit for controlling the electrical components is disclosed, for example, in Japanese Patent Laid-open Publication No. 2000-80621.

The snow removing machine disclosed in that publication has a large body, providing a relatively large space on each of the right and left sides of an engine even if the engine is disposed at about the center of the body. A battery is disposed in a space on the left of the engine, and a control unit is disposed in a space on the right of the engine.

The large snow removing machine is a heavy load, requiring a relatively large operating force for snow removing operations. There is thus a demand for practical small snow removing machines which can be easily operated by a small operating force.

Since small snow removing machines have a small body, it is difficult for them, when an engine is mounted to the body, to provide spaces on the right and left of the body for disposing a battery and a control unit. It is thus necessary to dispose the battery and the control unit at other places.

However, since the battery and the control unit are relatively heavy loads, it is necessary to determine the places where these components are disposed, considering the weight balance of the snow removing machine. It is thus desired, in small snow removing machines, to dispose a battery and a control unit in such a manner as to maintain a good weight balance.

A snow removing machine having a controller for detecting, with sensors, the orientation of a chute, the inclination of a chute cap and the traveled distance, and adjusting the orientation of the chute and the inclination of the chute cap based on the detected values, is disclosed, for example, in Japanese Utility Model Laid-Open Publication No. HEI-2-136122. The controller is mounted to a control box provided between right and left handle bars.

Means of mounting the controller to the control box may be bolting. However, when the controller is directly bolted to the control box, vibration transmitted from a travel device and a snow removing device to the body of the snow removing machine is directly transmitted to the controller through the right and left handle bars and the control box. Consequently, the controller can vibrate, affecting the control. It is thus desired to reduce vibration acting on the controller.

SUMMARY OF THE INVENTION

According to the present invention, there is provided a snow removing machine, which comprises: a body; a blower housing disposed at the front of the body; a chute provided on the blower housing, extending upward; a battery for supplying power to electric motors for driving travel devices disposed at the right and left of the body; and a control unit for controlling rotations of the electric motors and other electrical components; the battery and the control unit being provided next to the chute in a body width direction on the blower housing.

Preferably, the battery is provided next to the chute, and the control unit is provided next to the battery.

Preferably, the chute is provided on the right or left side of the blower housing, while the battery and the control unit are provided on the opposite side to the chute on the blower housing.

Thus, the chute of the snow removing machine is provided on a left upper portion of the blower housing, for example, for receiving snow thrown up by the blower. Consequently, there is a dead space on the right of the chute, that is, above the right side of the blower housing. Therefore, the battery and the control unit can be disposed next to the chute in this order in a body width direction so as to utilize the dead space beside the chute, disposing the battery and the control unit.

The chute is located at the front of the body and the battery and the control unit are disposed beside the chute, so that the battery and the control unit are disposed at the front side of the snow removing machine. Thus, the battery and the control unit as heavy loads are disposed at the front of the snow removing machine to determine the weight balance, preventing the rising of a snow removing device. As a result, the snow removing device has an improved ability to break into snow, improving operability.

The control unit is preferably mounted on the blower housing with vibro-isolating members interposed therebetween. The vibro-isolating members comprise lower vibro-isolating materials provided at a lower portion of the control unit for preventing mainly vertical vibration, and upper vibro-isolating materials provided at an upper portion of the control unit for preventing mainly horizontal vibration.

Thus, the lower vibro-isolating materials provided at the lower portion of the control unit damp vertical vibration of the control unit. The upper vibro-isolating materials provided at the upper portion of the control unit damp horizontal vibration of the control unit.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
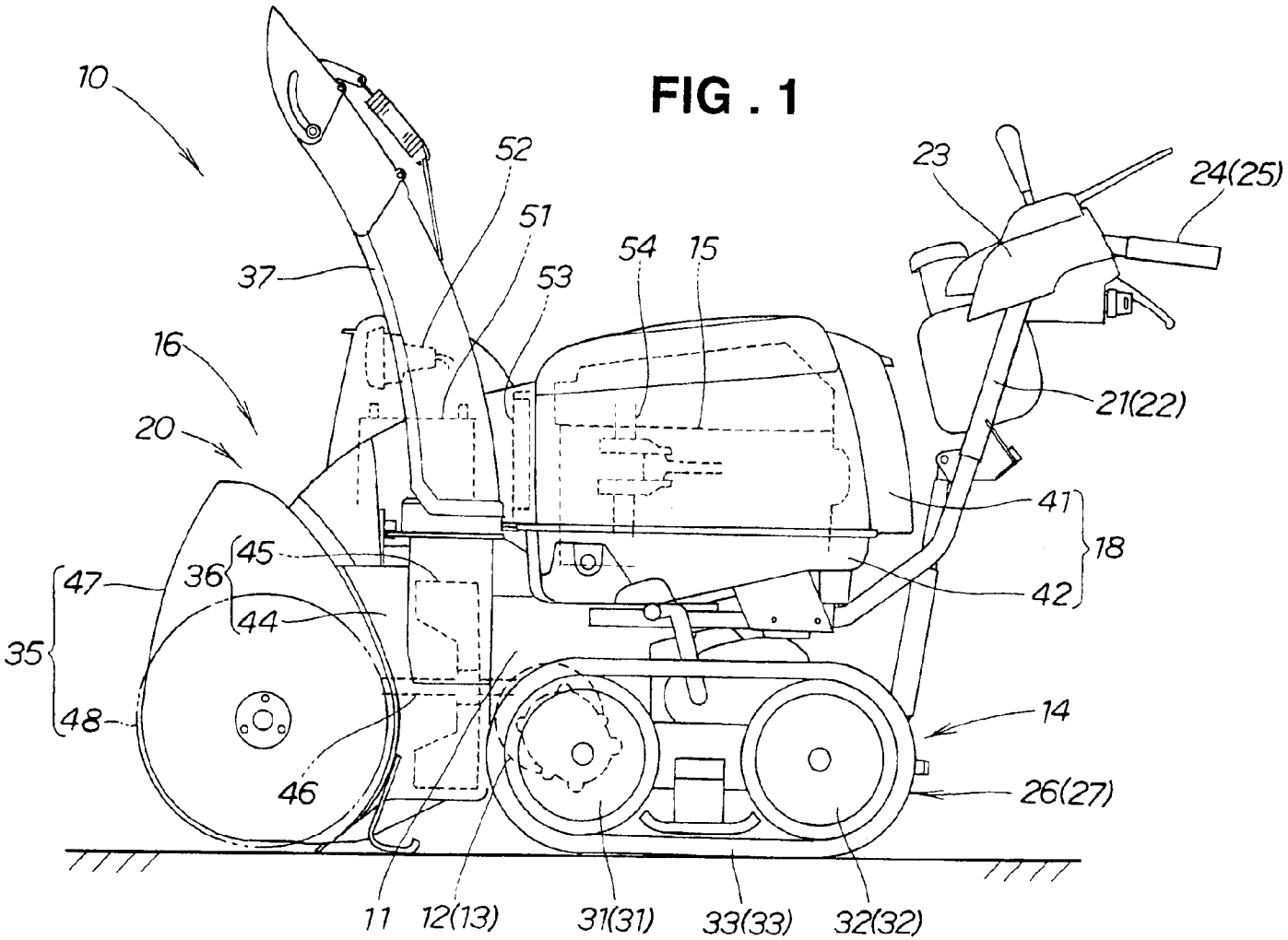
FIG. 1 is a side view of a snow removing machine according to the present invention.

A snow removing machine 10 in this embodiment is a self-propelled walk-behind working machine led by an operator walking behind the body, holding grips 24, 25 of left and right handle bars 21, 22.

A transmission case 11 constitutes a part of the body of the snow removing machine 10. Left and right electric traction motors 12, 13 are provided at lower left and right portions of the transmission case 11, respectively, and connected to a travel device 14 provided below the transmission case 11.

An engine 15 is mounted on top of the transmission case 11. A snow removing device 16 driven by the engine 15 is provided at the front of the transmission case 11. The rear of the snow removing device 16 and the engine 15 are enclosed by a cover 18.

The left and right handle bars 21, 22 extend from the rear of the transmission case 11 in a rearward and upward direction with inclination. A control panel 23 is mounted between the left and right handle bars 21, 22.

The engine 15 is disposed at about the longitudinal center of the transmission case 11. The travel device 14 (left and right travel units 26, 27) is disposed at about the longitudinal center of the transmission case 11.

The travel device 14 includes the left travel unit 26 disposed outside the left electric motor 12, and the right travel unit 27 disposed outside the right electric motor 13.

The left travel unit 26 includes a left drive wheel 31 connected to the left electric motor 12, a left idle wheel 32 rotatably provided rearward of the drive wheel 31, and a crawler belt 33 running between the left drive wheel 31 and the left idle wheel 32.

The left and right travel units 26, 27 are designed to be driven by the electric motors 12, 13, respectively, to motorize the snow removing machine 10.

The right travel unit 27 has the same configuration as that of the left travel unit 26, and is given identical reference numerals to those of the left travel unit 26 to avoid description.

The snow removing device 16 is a working unit including an auger assembly 35, a blower assembly 36 and a chute 37.

In the description of this embodiment, a body 20 consists of the transmission case 11 and the snow removing device 16.

The snow removing machine 10 travels with the left and right drive wheels 31, 31 driven by the left and right electric motors 12, 13, rotating the left and right crawler belts 33, 33. Under this travel state, the snow removing device 16, i.e., the auger assembly 35 and the blower assembly 36 are driven by the engine 15 for snow removing operations.

Figure 3:
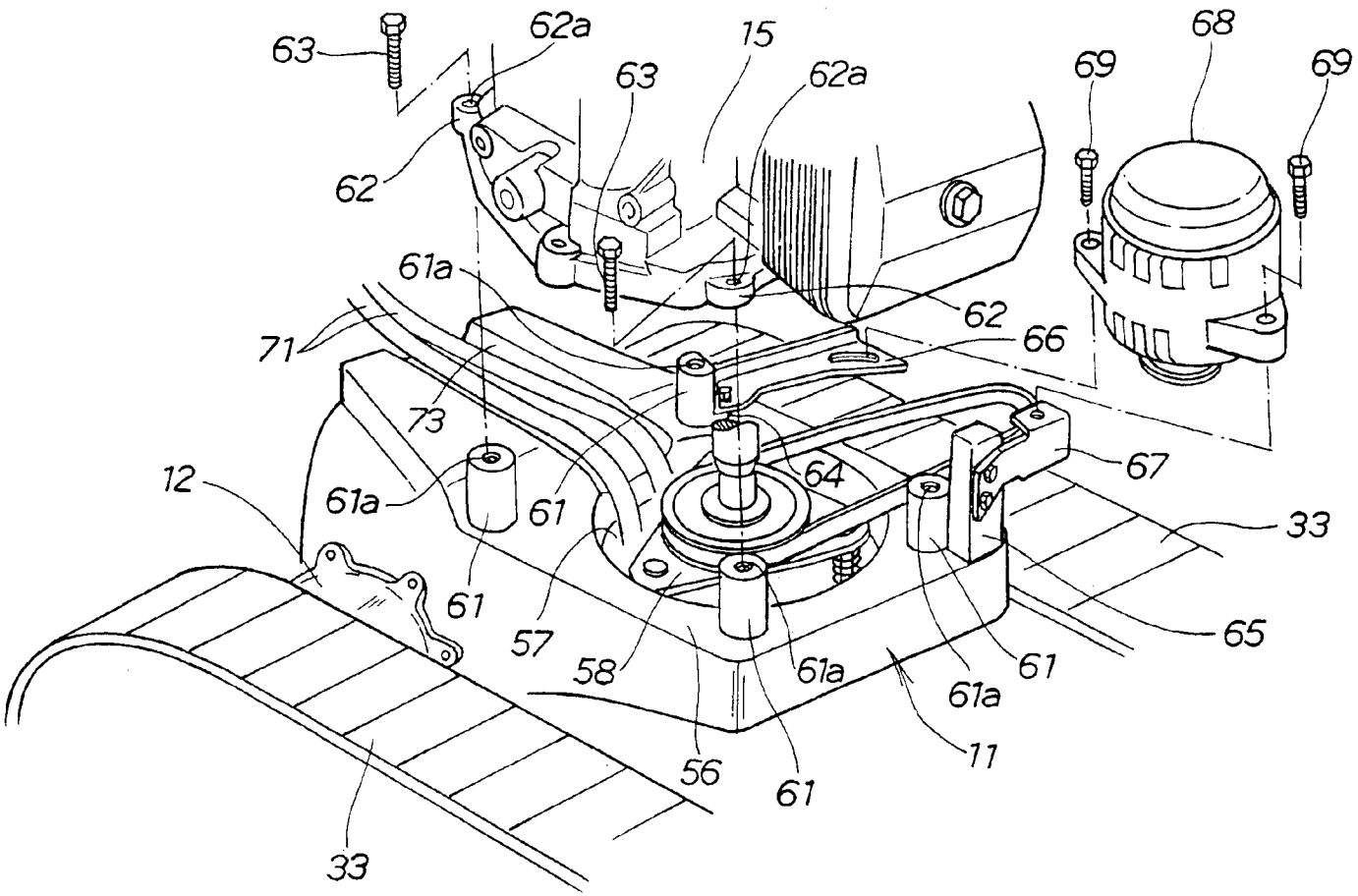
FIG. 3 is a perspective view showing the mounting relationship between a transmission case and the engine of the snow removing machine shown in FIG. 1.

The transmission case 11 also serves as a part of the body of the snow removing machine 10, provided at about the center of the snow removing machine 10, formed in a substantially rectangular shape in a plan view (see FIG. 3).

The cover 18 consists of an upper cover part 41 and a lower cover part 42. The lower cover part 42 covers the bottom of the engine 15, and the upper cover part 41 covers an upper portion of the engine 15, whereby the engine 15 is entirely covered.

The blower assembly 36 includes a blower housing 44 mounted to the front of the transmission case 11, a blower 45 disposed within the blower housing 44, and a drive shaft 46 on which the blower 45 is mounted.

The auger assembly 35 includes an auger housing 47 mounted to the front of the blower housing 44 and an auger 48 rotatably mounted within the auger housing 47.

Figure 2:
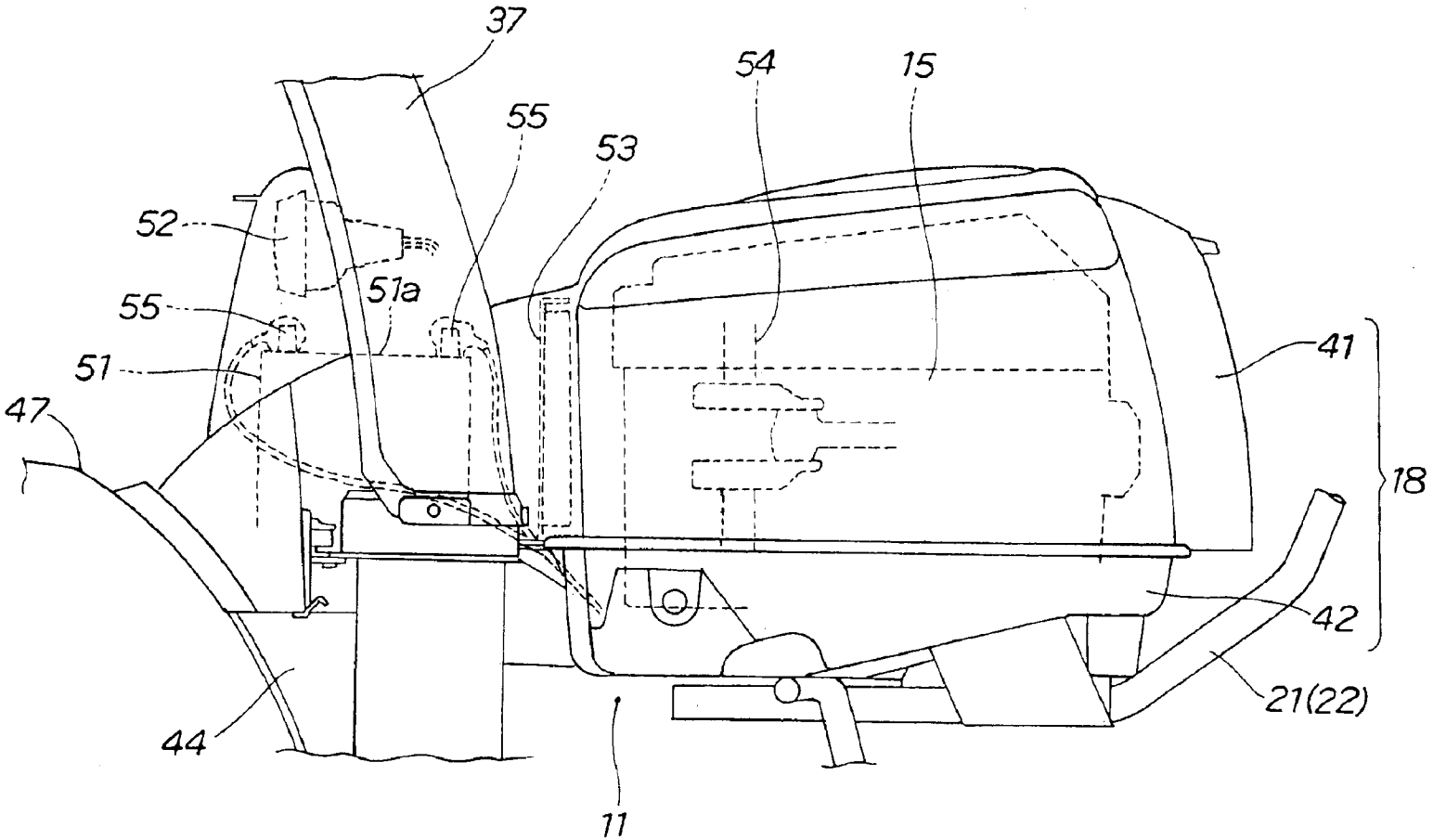
FIG. 2 is a side view showing the dispositional relationship between an engine and a battery of the snow removing machine shown in FIG. 1.

FIG. 2 shows the relationship between the engine 15 and the battery 51 of the snow removing machine 10.

The engine 15 is mounted on the transmission case 11. The battery 51 is disposed in front of the engine 51 and on top of the blower housing 44. A light 52 is disposed on the battery 51.

The battery 51 is formed in a box-like shape, having terminals 55, 55 on its top surface 51*a*.

A bulkhead 53 for intercepting heat from the engine 15 toward the battery 51 is provided between the engine 15 and the battery 51. The engine 15 is a vertical engine of a type in which a crankshaft 54 is positioned vertically.

The lower cover part 42 of the cover 18 is mounted on the transmission case 11. The upper cover part (cover) 41 attached to the lower cover part 42 covers the battery 51, the light 52, the engine 15 and the bulkhead 53 together.

FIG. 3 shows the mounting relationship between the transmission case 11 and the engine 15.

A housing recess 57 for holding an electromagnetic clutch 58 is formed in an upper portion 56 of the transmission case 11. On the upper portion 56 of the transmission case 11, four mounting bosses 61 are provided in a standing manner around the housing recess 57, surrounding the electromagnetic clutch 58.

The engine 15 is provided with four overhanging portions 62 (only two are shown) at the locations corresponding to those of the four mounting bosses 61. Each of the overhanging portions 62 is formed with a mounting hole 62*a* corresponding to a screw hole 61*a* formed in the mounting boss 61.

Bolts 63 are inserted into the respective mounting holes 62*a*, and the inserted bolts 63 are screwed into the respective screw holes 63*a*, whereby to mount the engine 15 to the four mounting bosses 61.

Of the four mounting bosses 61, the mounting boss 61 located at the right front is formed with a front mounting portion 64, and near the mounting boss 61 located at the right rear, a rear mounting portion 65 is provided.

A front mounting bracket 66 is bolted to the front mounting portion 64, and a rear mounting bracket 67 is bolted to the rear mounting portion 65. A generator 68 is fixed to the front and rear mounting brackets 66, 67 with bolts 69, 69.

At left and right front lower portions of the transmission case 11, the left and right electric motors 12, 13 (the right electric motor 13 is behind the transmission case 11 and is not seen) are provided, respectively. The left and right crawler belts 33, 33 are driven by the left and right electric motors 12, 13, respectively.

Figure 5:
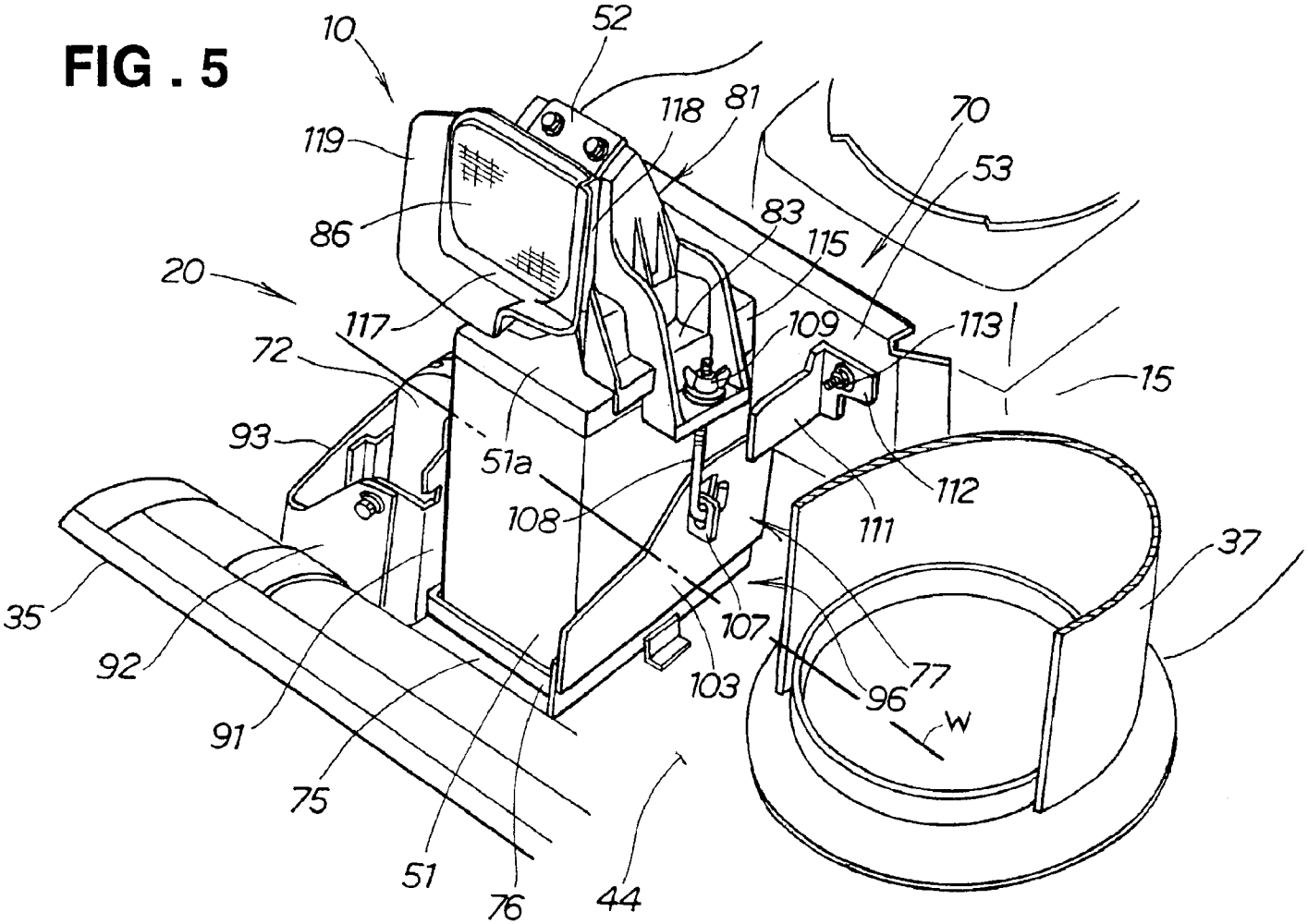
FIG. 5 is a perspective view showing the dispositional relationship between a chute, the battery and a control unit, which are provided on a blower housing.
Figure 6:
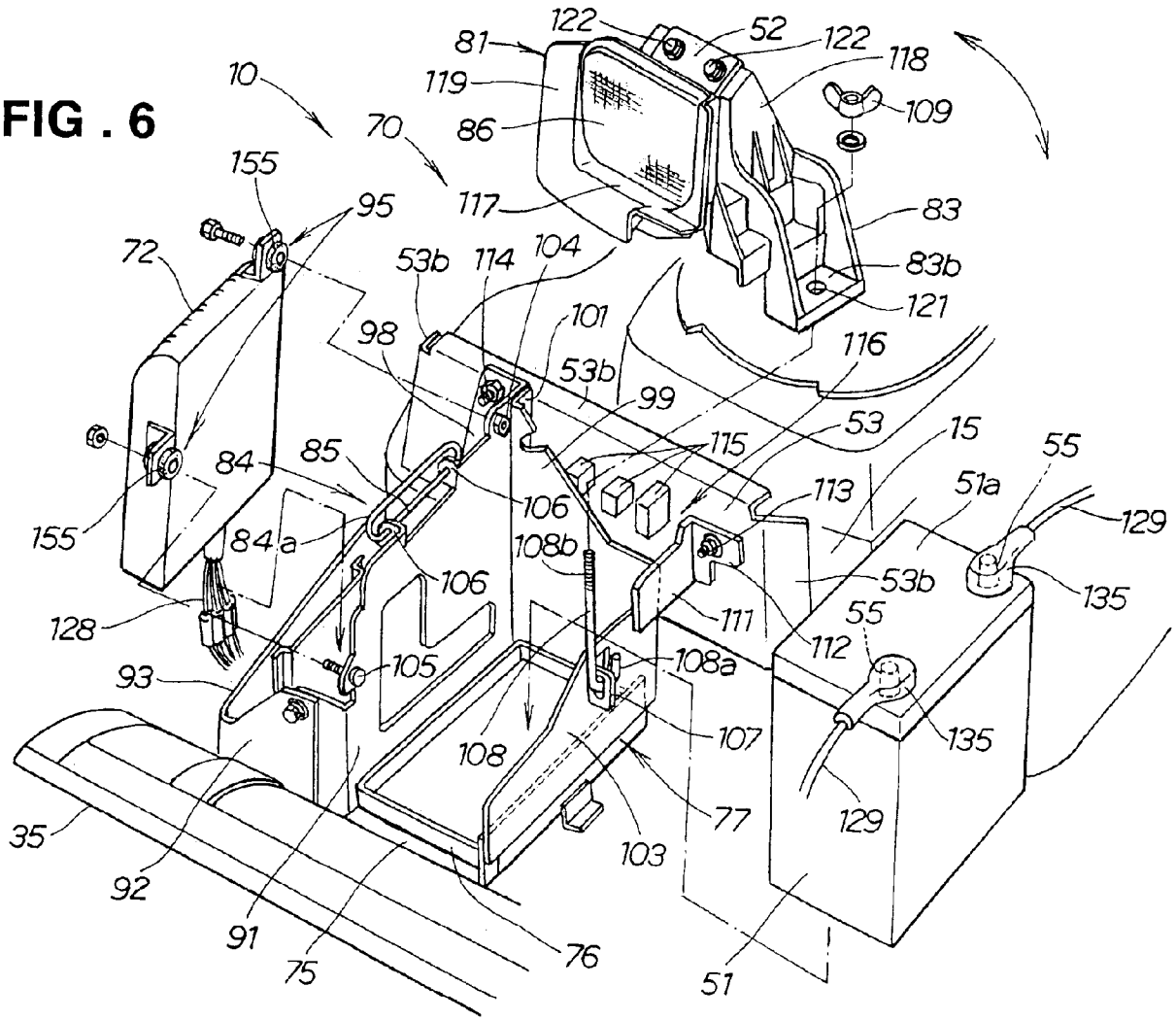
FIG. 6 is an exploded perspective view of the battery and the control unit dismounted.

The left and right electric motors 12, 13 and the electromagnetic clutch 58 are connected to a control unit 72 shown in FIGS. 5 and 6 via wire harnesses 71. Specifically, the wire harnesses 71 are connected at their first ends to the left and right electric motors 12, 13 and the electromagnetic clutch 58, and the wire harnesses 71 thus connected are extended forward from the front of the housing recess 57 along a guide groove 73 formed in the top of the transmission case 11. Second ends of the wire harnesses 71 extended forward are connected to the control unit 72.

Figure 4:
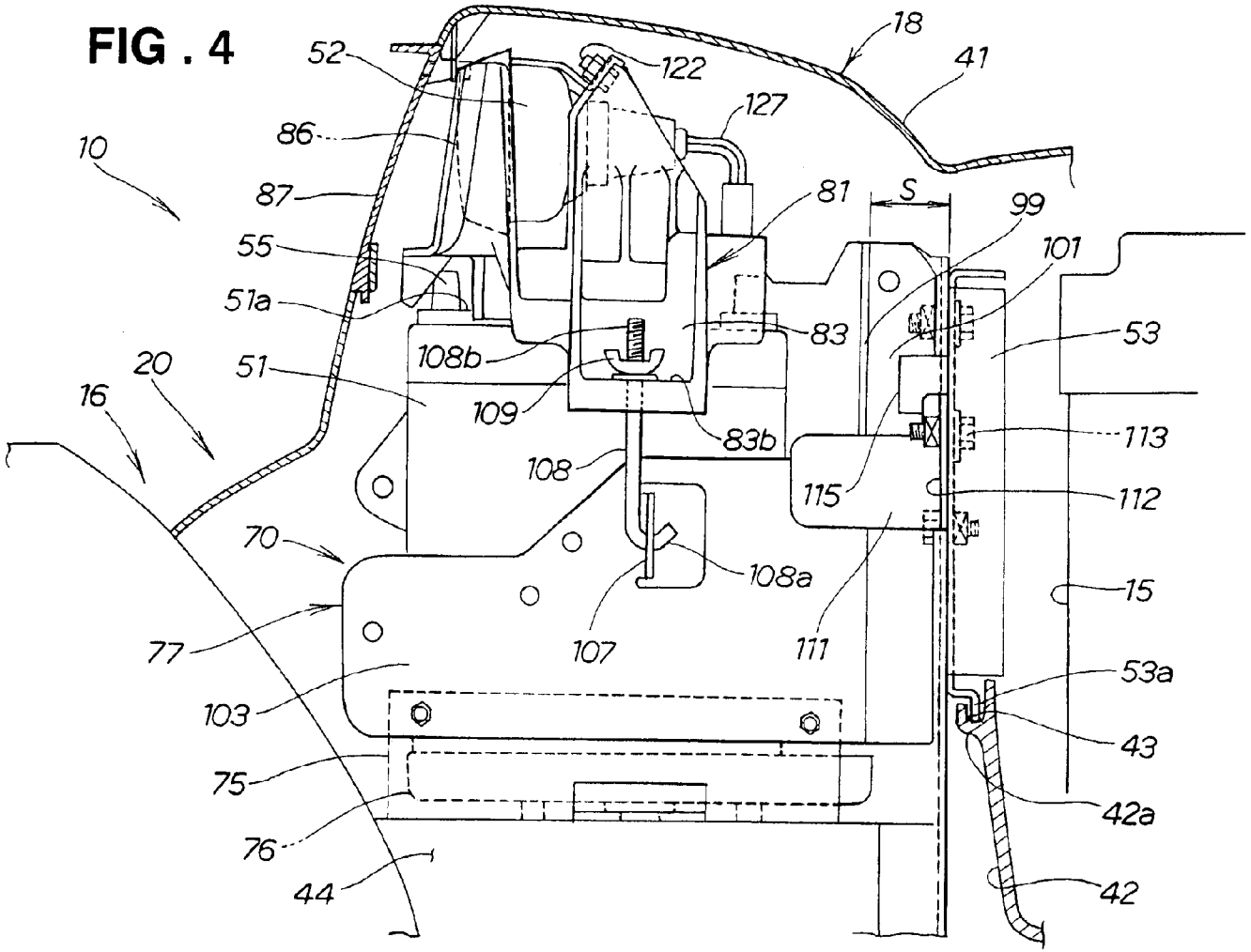
FIG. 4 is a side view showing the mounted state of the battery disposed in front of the engine, and a light.

As shown in FIG. 4, the snow removing machine 10 in this embodiment has a battery support unit 70 provided on the blower housing 44 which constitutes a part of the body 20.

The battery support unit 70 has a battery holder 77 into which the box battery 51 having the terminals 55, 55 on the top surface 51*a* (see also FIG. 6) can be placed from above or laterally, and is designed to press the top surface 51*a* of the battery 51 placed in the battery holder 77 with a battery fastening member 81. The battery fastening member 81 is an insulating resin component.

The battery support unit 70 will be described in detail below.

On a mounting bracket 75 mounted on a top portion of the blower housing 44, a battery mounting plate 76 is mounted and also the battery holder 77 is mounted. The bulkhead 53 is attached to the rear of the battery holder 77, and a lower bent portion 53*a* of the bulkhead 53 is inserted into a U-shaped receiving groove 43. In this manner, the bulkhead 53 is interposed between the battery holder 77 and the engine 15. The U-shaped receiving groove 43 is a U-shaped groove formed in a front upper edge 42*a* of the lower cover part 42.

The battery 51 is put into the battery holder 77 to place the battery 51 on the battery mounting plate 76. A right end portion (a first end portion) 82 (see FIG. 7) of the battery fastening member 81 is hinged to the battery holder 77 via a hinge rod (see FIGS. 6 and 7) 85, and a left end portion (a second end portion) 83 is detachably joined to the battery holder 77 via a hook bolt 108 and a butterfly nut 109.

The battery fastening member 81 presses the top surface 51*a* of the battery 51 to retain the battery 51.

The battery 51 is housed in the battery holder 77 so as to separate the battery 51 from the engine 15 with the bulkhead 53.

The battery 51, the light 52, the engine 15 and the bulkhead 53 in this state are covered together by the upper cover part 41 (cover 18), so that the upper cover part 41 entirely covers the battery 51.

As a battery protecting means, a means of covering an upper portion of a battery with a cover is generally adopted. With this means, however, rain or snow on the sidewall of the battery 51 can enter a battery upper portion from between the battery and the cover.

To avoid this, the upper cover part 41 is configured to entirely cover the battery 51. It thus becomes possible to prevent entering of rain and snow from the sidewall into an upper portion of the battery 51, reliably protecting the battery 51 from rain and snow.

The bulkhead 53 is provided between the engine 15 and the battery 51 so that the bulkhead 53 intercepts heat from the engine 15 toward the battery 51. The battery 51 is thus protected from being affected by heat generated from the engine 15.

The light 52 is mounted on the battery fastening member 81, and is covered by the upper cover part 41 together with the battery 51.

A portion of the upper cover part 51 opposite to a front surface 86 of the light 52 is a translucent part 87 through which light can pass. When the light 52 throws light, the light radiates forward of the snow removing machine 10 through the front surface 86 and the translucent part 87.

As shown in FIG. 5, the chute 37 is provided on an upper left portion of the blower housing 44. The mounting bracket 75 is mounted on the blower housing 44 on the right of the chute 37 and in front of the engine 15. The battery holder 77 of the battery support unit 70 is mounted to the mounting bracket 75 to be located on the right of the chute 37.

The bulkhead 53 is attached to a rear end portion of the battery holder 77 so that the battery 51 housed in the battery holder 77 is separated from the engine 15 with the bulkhead 53.

A guard member 92 is attached to a right wall 91 of the battery holder 77 (see also FIG. 6) so that the guard member 92 and the right wall 91 form a control unit holder 93.

The battery fastening member 81 of the battery support unit 70 is placed on the battery 51 disposed in the battery holder 77, and the right end portion (first end portion) 82 of the battery fastening member 81 (see FIG. 7) is hinged to the battery holder 77 with the hinge rod 85 (see FIG. 7), and the left and portion (second end portion) 83 is detachably joined to the battery holder 77 via the hook bolt 108 and the butterfly nut 109. In this manner, the battery fastening member 81 presses the top surface 51*a* of the battery 51 to fix the battery 51.

The control unit 72 is disposed in the control unit holder 93. The control unit 72 is attached to the right wall 91 of the battery holder 77 with vibro-isolating members 95 interposed therebetween (see FIG. 6).

The battery 51 is disposed on the right of the chute 37, and the control unit 72 is disposed on the right of the battery 51. That is, the battery 51 and the control unit 72 are aligned in a width direction of the transmission case (body) 11 (see FIGS. 3 and 5).

Now, the reason why the battery 51 and the control unit 72 are disposed beside the chute 37 in this order will be described.

The blower 45 (see FIG. 1) throws up snow in centrifugal directions. For receiving the thrown-up snow, the chute 37 of the snow removing machine 10 is provided on either right or left upper portion of the blower housing 44, for example. In this embodiment, it is provided on a left upper portion.

Consequently, there is a space 96 (so-called dead space) on the right of the chute 37, that is, above the right side of the blower housing 44. Therefore the battery 51 and the control unit 72 are aligned next to the chute 37 in this order in a width direction of the transmission case 11. As best shown in FIG. 5, the chute 37, the battery 51 and the control unit 72 are all disposed along a widthwise axis W of the snow removing machine 10. In this manner, the space beside the chute 37 can be utilized to dispose the battery 51 and the control unit 72.

The battery 15 stores electric power generated by the generator 68 (see FIG. 3), and supplies the power to electrical components such as the left and right electric motors 12, 13 (see FIG. 1) for the travel device 14. The left and right electric motors 12, 13 supplied with power drive the left and right travel units 26, 27, respectively (see FIG. 1).

The control unit 72 controls electrical components such as the electric motors 12, 13 for the travel device 14, or specifically, controls power supply and so on. The left and right electric motors 12, 13 are controlled to adjust the driven states of the left and right travel units 26, 27 (see FIG. 1).

As shown in FIG. 6, the battery holder 77 of the battery support unit 70 has the right wall 91 arranged on the right of the battery 51. The right wall 91 is fixed to the mounting bracket 75. The right wall 91 has a bent portion 98 at its rear edge. To the bent portion 98, a bent portion 101 of a rear wall 99 is attached (see FIG. 10). The rear wall 99 is disposed at a predetermined distance from the bulkhead 53, extending leftward in parallel with the bulkhead 53. The left end of the rear wall 99 is bent forward to form a left wall 103. The left wall 103 extends forward in parallel with the right wall 91. The left and right walls 103, 91 are attached to the mounting bracket 75. The right wall 91, rear wall 99 and left wall 103 form a substantially U shape in a plan view.

The right wall 91 has at its upper portion a nut 104 for mounting the control unit 72, and has at its upper portion a first portion 84*a* of a hinge 84, and also has at the front a bolt 105 for mounting the control unit 72.

The first portion 84*a* of the hinge 84 is provided with rightward protruding portions 106, 106 spaced at a certain interval, and the hinge rod 85 is fitted into through holes in the protruding portions 106, 106.

The left wall 103 has a protruding portion 107 protruding leftward, and the hook bolt 108 is engaged in an engaging hole in the protruding portion 107. The hook bolt 108 has a lower portion 108*a* bent into a shape to be able to be engaged in the engaging hole of the protruding portion 107, and has an upper portion 108*b* formed with a male screw.

The bulkhead 53 is attached with a bolt 113 to a bent portion 112 of a support member 111 attached to a rear end portion of the left wall 103, and is also attached to the bent portion 98 of the right wall 91 with a bolt 114, thereby being attached to the battery holder 77.

The bulkhead 53 is at a predetermined distance S from the rear wall 99 (see FIG. 4) to provide a space 116 in which to dispose a plurality of relays 115 for electrical components driven by power of the battery 51. The relays 115 are attached to the bulkhead 53, using the space 116.

The bulkhead 53 is a plate formed in a substantially rectangular shape, and has a rearward bent portion 53*b* at each of its upper, right and left edges, and has a lower bent portion 53*a* at its lower portion (see FIG. 4). The lower bent portion 53*a* and the bent portions 53*b* provide the bulkhead 53 with rigidity. Thus, the bulkhead 53 can support the relays 115.

As shown in FIG. 4, the lower bent portion 53*a* of the bulkhead 53 is inserted into the U-shaped receiving groove 43 of the lower cover part 42, whereby the bulkhead 53 is supported. Like this, the lower cover part 42 is also used as a component for supporting the bulkhead 53 to reduce the number of components and simplify the assembly structure.

Since the relays 115 for electrical components driven by power of the battery 51 are attached to the bulkhead 53, the bulkhead 53 has both the function of intercepting heat from the engine 15 and the function of supporting the relays 115. Consequently, there is no need to prepare mounting members for the individual relays 115, and it becomes possible to prevent an increase in the number of components and to simplify the assembly process.

The battery fastening member 81 is joined to the battery holder 77 of the battery support unit 70 to retain the battery 51. The battery fastening member 81 is an insulating resin component, and has a base 117 on which the light 52 is placed. Left and right supports 118, 119 are formed at the left and right sides of the base 117, respectively. The base 117 and the left and right supports 118, 119 form a substantially U-shaped frame. The light 52 is disposed in the frame.

The insulating resin component may be made from polyphenylene oxide resin such as "NORYL®" (manufactured by Japan GE Plastics [GE]), for example, but is not limited thereto. "NORYL®" is a resin having good dimensional stability and mechanical properties of less temperature dependency and so on, suitable for forming the battery fastening member 81.

The light 52 is fixed to top portions of the left and right supports 118, 119 with bolts 122, 122. The left end portion 83 of the base 117 extends downward, and a lower portion 83*b* of the left end portion 83 is formed with a mounting hole 121. The right end portion 82 of the base 117 (see FIG. 7) has a second portion 84*b* of the hinge 84 (see FIG. 7).

The second portion 84*b* of the hinge 84 is rotatably mounted on the hinge rod 85 at the battery holder 77. The right end portion 82 of the battery fastening member 81 is attached rotatably in arrow directions (see also FIG. 7) to the right wall 91.

Figure 7:
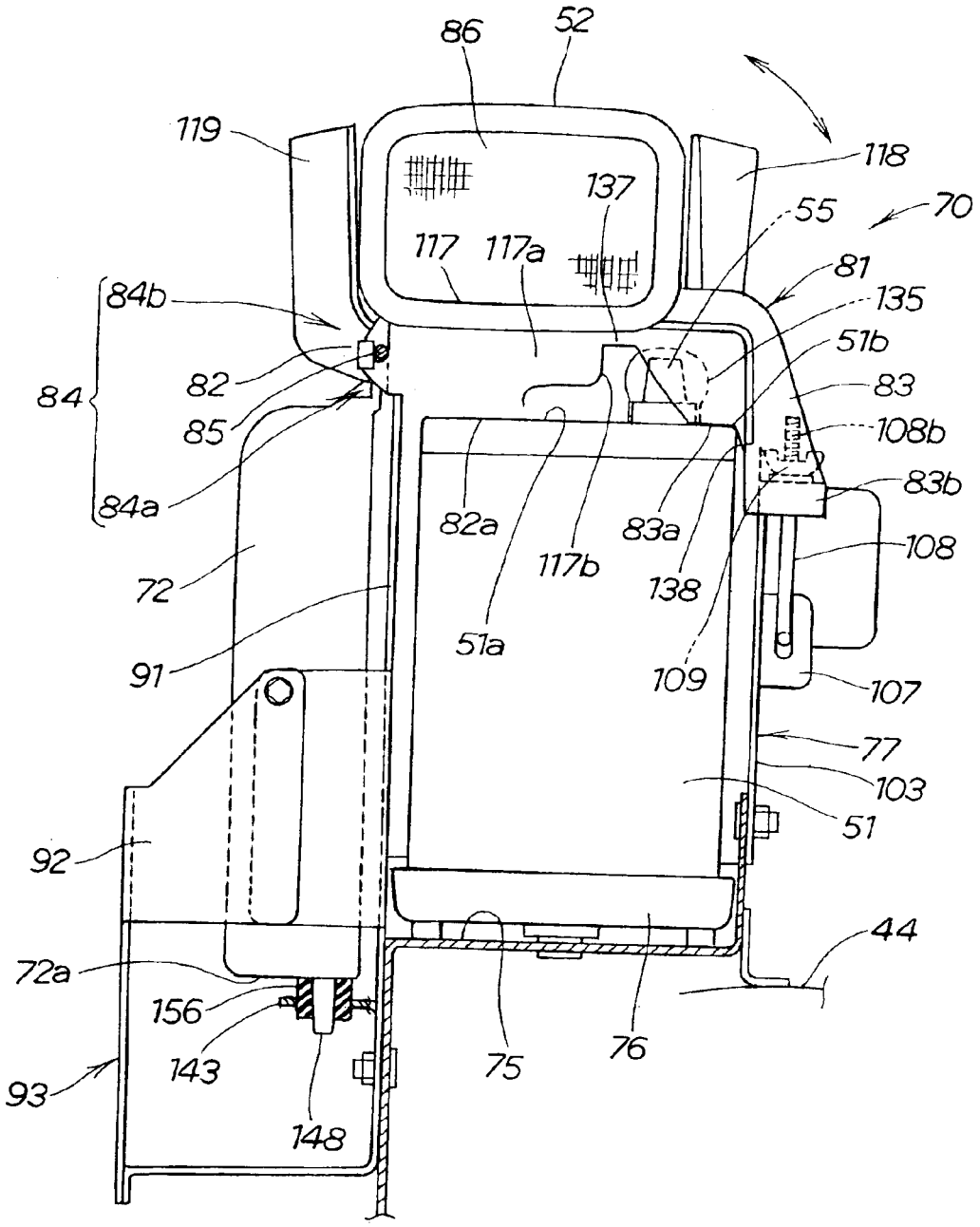
FIG. 7 is a front view showing the relationship between the battery and a battery fastening member.

Under this state, the upper portion 108*b* of the hook bolt 108 is inserted into the mounting hole 121 of the left end portion 83, and the butterfly nut 109 is screwed onto the upper portion 108*b* protruded from the mounting hole 121, whereby the top surface 51*a* of the battery 51 is pressed into the battery holder 77 with the battery fastening member 81 (see FIGS. 4, 5 and 7).

The light 52 is provided on the battery 51 via the battery fastening member 81. Consequently, a battery presser plate conventionally required for retaining the battery 51 and a stay conventionally required for retaining the light 52 can be a common member, resulting in a reduced number of components.

Since the light 52 is provided on the battery 51 so that the light 52 is close to the battery 51, a harness (electric wire) 127 for lighting connected to the light 52 (see FIG. 4) can be shortened. This facilitates the provision of a space for the wiring of the electric wire 127 for lighting, increasing the design freedom.

The hinging of the right end portion 82 of the battery fastening member 81 to the battery holder 77 prevents the battery fastening member 81 from being carelessly dropped when the battery 51 is removed. Thus, the battery fastening member 81 is prevented from dropping, damaging the light 52, or damaging the electric wire 127 for lighting connected to the light 52 (see FIG. 4).

The control unit 72 is housed in the control unit holder 93 formed with the right wall 91 and the guard member 92. The control unit 72 is attached to the right wall 91 of the battery holder 77 with the vibro-isolating members 95 interposed therebetween (see also FIG. 10).

The location of the control unit 72 proximate to the battery 51 (specifically, proximate to the right side of the battery 51) allows a wire harness 128 for connecting the control unit 72 and the battery 51 to be shortened.

Electric wires 129, 129 connected to the terminals 55, 55 of the battery 51, respectively, are bound into the wire harness 128.

The battery 51, the light 52 and the control unit 72 are arranged close to one another, and these electrical members 51, 52 and 72 are arranged close to the left and right electric motors 12, 13, the electromagnetic clutch 58 and the generator 68 shown in FIG. 3. Consequently, the wire harness 71 (see FIG. 3), the wire harness 128, the electric wires 129 and the harness (electric wires) 127 for lighting (see FIG. 4) for connecting the electrical members 51, 52, 72, 12, 13, 58 and 68 are shortened to avoid voltage drops due to wire resistance. This effect is demonstrated especially in small snow removing machines. The shortness of the harnesses facilitates the wiring of the harnesses.

FIG. 7 shows the relationship between the battery 51 and the battery fastening member 81.

The battery holder 77 of the battery support unit 70 is provided on the mounting bracket 75 mounted on the blower housing 44. The battery 51 is housed in the battery holder 77, and the top surface 51*a* of the battery 51 is pressed by the battery fastening member 81 of an insulating resin component.

The right end portion 82 of the battery fastening member 81 constituting a part of the battery support unit 70 is joined to the battery holder 77 via the hinge 84, and the left end portion 83 of the battery fastening member 81 is detachably joined to the battery holder 77 via the hook bolt 108 and the butterfly nut 109.

Now, the hinge 84 shown in FIG. 7 will be described with reference to FIGS. 8A and 8B.

The right end portion 82 of the battery fastening member 81 has the second portion 84*b* of the hinge 84 (see FIG. 7).

Figure 8A:
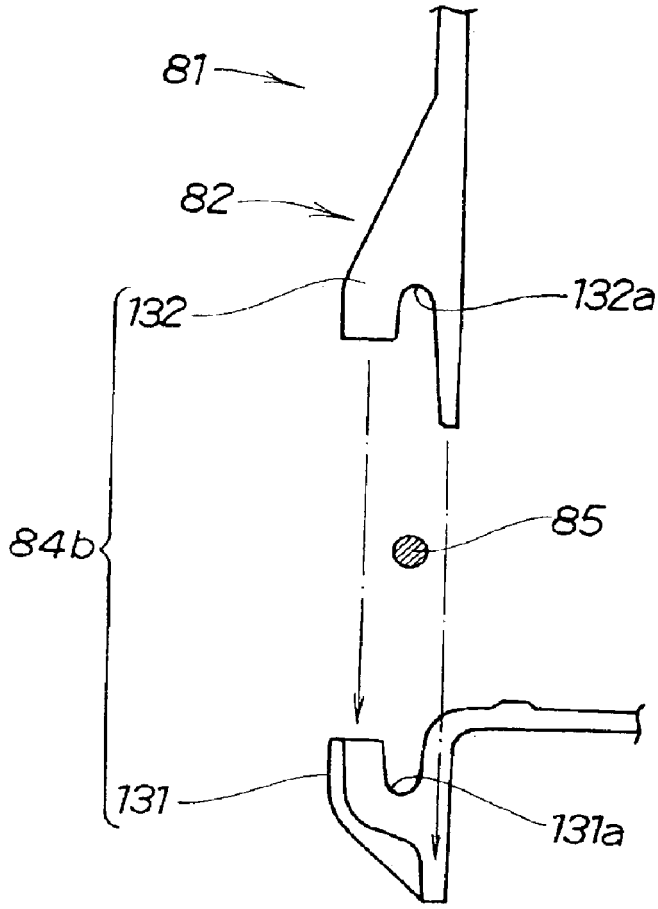
FIGS. 8A and 8B are diagrams showing a hinge of the battery fastening member.

As shown in FIG. 8A, the second portion 84*b* includes an upward portion 131 in which an upward groove 131*a* is formed and a downward portion 132 in which a downward groove 132*a* is formed.

Figure 8B:
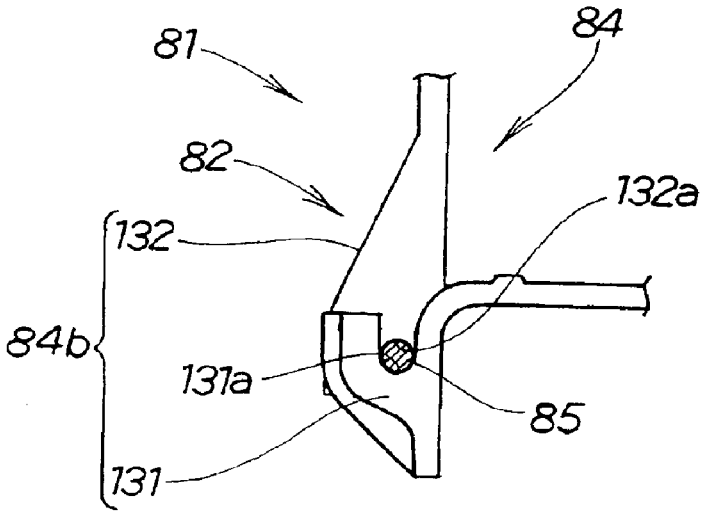

As shown in FIG. 8B, the upward groove 131*a* and the downward groove 132*a* adjacent to one another are combined to rotatably hold the hinge rod 85 between the grooves 131*a*, 132*a*. That is, the upward groove 131*a* and the downward groove 132*a* are combined to perform an equivalent function to that of a usual through hole.

The combined structure of the upward groove 131*a* and the downward groove 132*a* eliminates the need for forming a through hole in the second portion 84*b* of the hinge 84. It thus becomes possible to simplify molding equipment for the battery fastening member 81, reducing the cost of equipment.

Now, the motion of the hinge 84 when the battery 51 is fixedly housed in the battery holder 77 will be described with reference to FIGS. 9A and 9B.

Figure 9B:
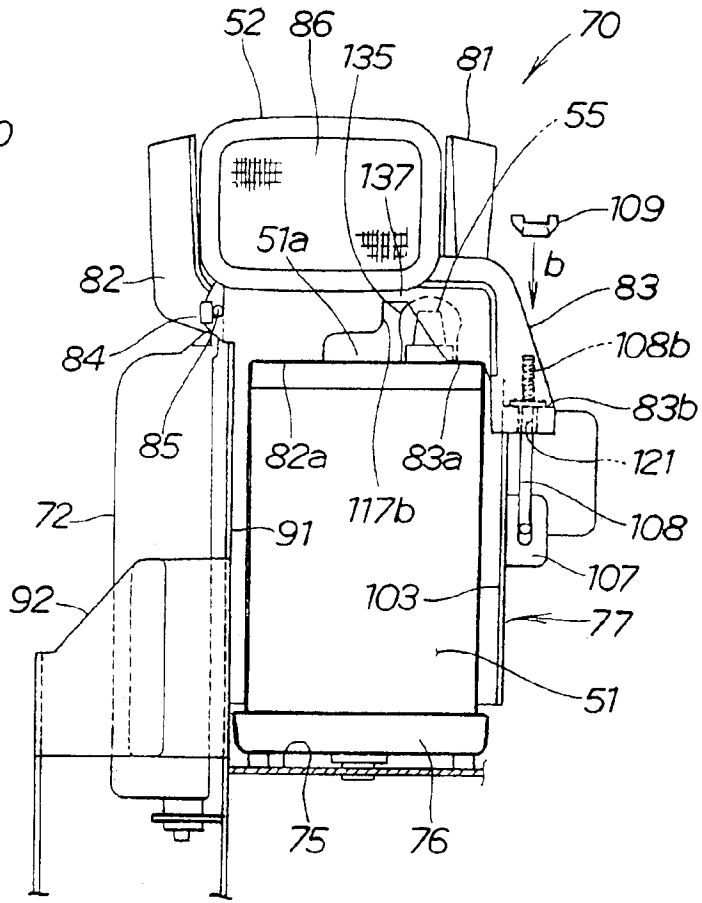
FIGS. 9A and 9B are diagrams showing the operation of fastening the battery by the battery fastening member on the hinge.
Figure 9A:
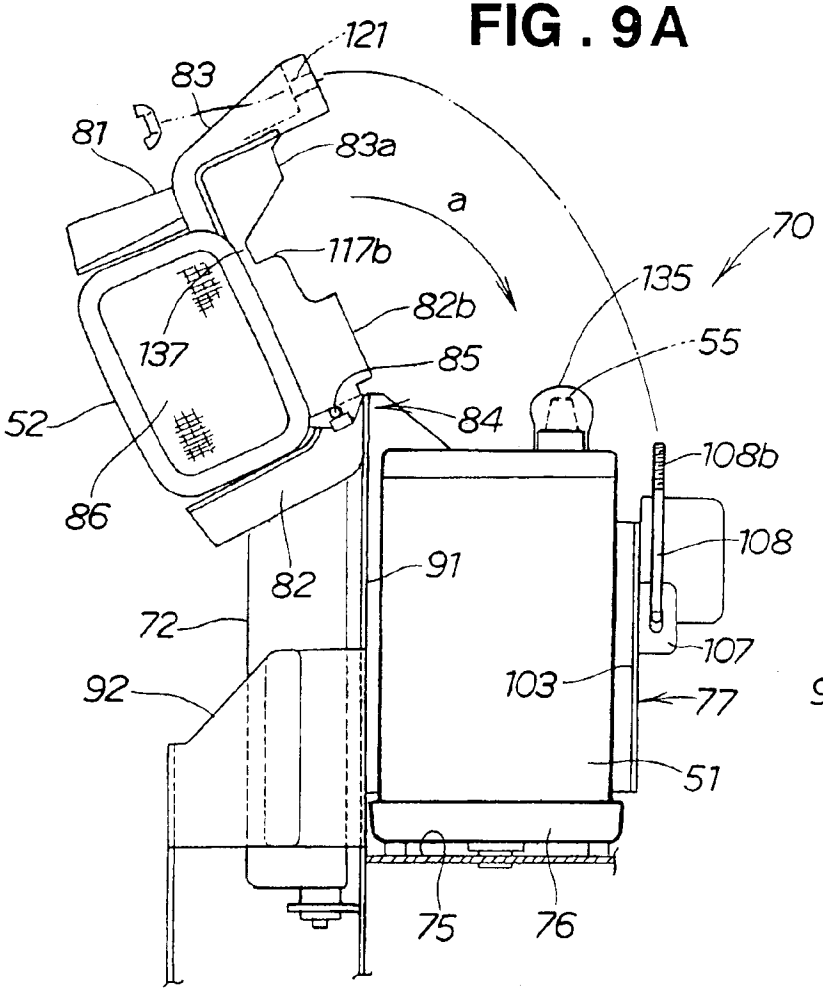

Referring to FIG. 9A, the battery 51 is housed from above into the battery holder 77 of the battery support unit 70, and the battery 51 is placed on the battery mounting plate 76. Next, the battery fastening member 81 is rotated with the hinge rod 85 as an axis as shown by arrow "a."

Then, as shown in FIG. 9B, the upper portion 108*b* of the hook bolt 108 is inserted into the mounting hole 121 of the left end portion 83 of the battery fastening member 81 constituting a part of the battery support unit 70 so that the upper portion 108*b* of the hook bolt 108 is protruded from the mounting hole 121.

The butterfly nut 109 is screwed onto the upper portion 108*b* protruded from the mounting hole 121 as shown by arrow "b." As a result, the top surface 51*a* of the battery 51 is pressed by the battery fattening member 81 to retain the battery 51 within the battery holder 77.

Turning back to FIG. 7 for description, since the battery fastening member 81 of the battery support unit 70 is an insulating resin component, the battery fastening member 81 is never short-circuited when contacting the terminals 55 of the battery 51. Thus, the mounting position of the battery fastening member 81 is not limited by the battery terminals 55. Further, since the battery fastening member 81 is an insulating resin component, there is no need to form a resin film over the surface of the battery fastening member 81.

To the terminals 55 of the battery 51, terminals (not shown) of the electric wires 129 (see FIG. 6) are usually connected, and the battery terminals 55 are covered by insulating cover members 135, respectively. The cover members 135 are, however, for protecting the battery terminals 55 from dust and the like, and it is unfavorable to contact a conductive member with the battery terminals 55. If a conductive component is used for a battery fastening member, it is necessary to avoid the battery terminals 55 when mounting the battery fastening member, and the mounting position of the battery fastening member is limited by the battery terminals 55.

Therefore, in this embodiment, the battery fastening member 81 is an insulating resin component to solve the above problem.

The battery fastening member 81 has an elastically deformable flexible portion 137 at a central portion (central portion of the battery fastening member) 117*a* in a width direction (transverse direction) of the base 117 or near the central portion 117*a*. The flexible portion 137 is formed by forming a hollow 117*b* in the center of the bottom of the base 117, reducing the thickness of the base 117. Thus forming the hollow 117*b* in the bottom center of the base 117 facilitates formation of the elastically deformable flexible portion 137.

The flexible portion 137 is elastically deformed to securely contact left and right abutting surfaces 83*a*, 82*a* provided at the left and right end portions (opposite end portions) 83, 82 of the battery fastening member 81, with the top surface 51*a* of the battery 51. The left and right abutting surfaces 83*a*, 82*a* are surfaces constituting the bottom surface of the base 117.

With the left and right abutting surfaces 83*a*, 82*a* in contact with the top surface 51*a* of the battery 51, the left and right abutting surfaces 83*a*, 82*a* of the battery fastening member 81 press and retain the battery 51.

The right end portion (first end portion) 82 of the battery fastening member 81 is hinged to the battery holder 77, and the left end portion (second end portion) 83 is detachably joined to the battery holder 77. Therefore, only by releasing the joint between the left end portion 83 of the battery fastening member 81 and the battery holder 77, the battery 51 can be removed from the battery holder 77. With the right end portion 82 of the battery fastening member 81 connected to the battery holder 77, the battery 51 can be removed from the battery holder 77.

The left end portion 83 of the battery fastening member 81 is provided with the abutting surface 83*a* which abuts on the top surface 51*a* of the battery 51 when the left end portion 83 is joined to the battery holder 77. Thus, without largely bending the elastically deformable flexible portion 137 more than necessary, the abutting surface 83*a* of the left end portion 83 can be brought in to contact with the top surface 51*a* of the battery 51.

The left end portion 83 is also provided with a tapered portion 138 which abuts on an upper corner 51*b* of the battery 51 when the right end portion 82 of the battery fastening member 81 is joined to the battery holder 77. The upper corner 51*b* of the battery 51 is pressed by the tapered portion 138 to move the battery 51 to the right end portion 82 of the battery fastening member 81, thereby to place the battery 51 at the normal position. This accepts the tolerance of the battery 51, providing good usability.

Now, the mounting structure of the control unit 72 disposed on the right of the battery 51 will be described with reference to FIGS. 10 to 13.

Figure 10:
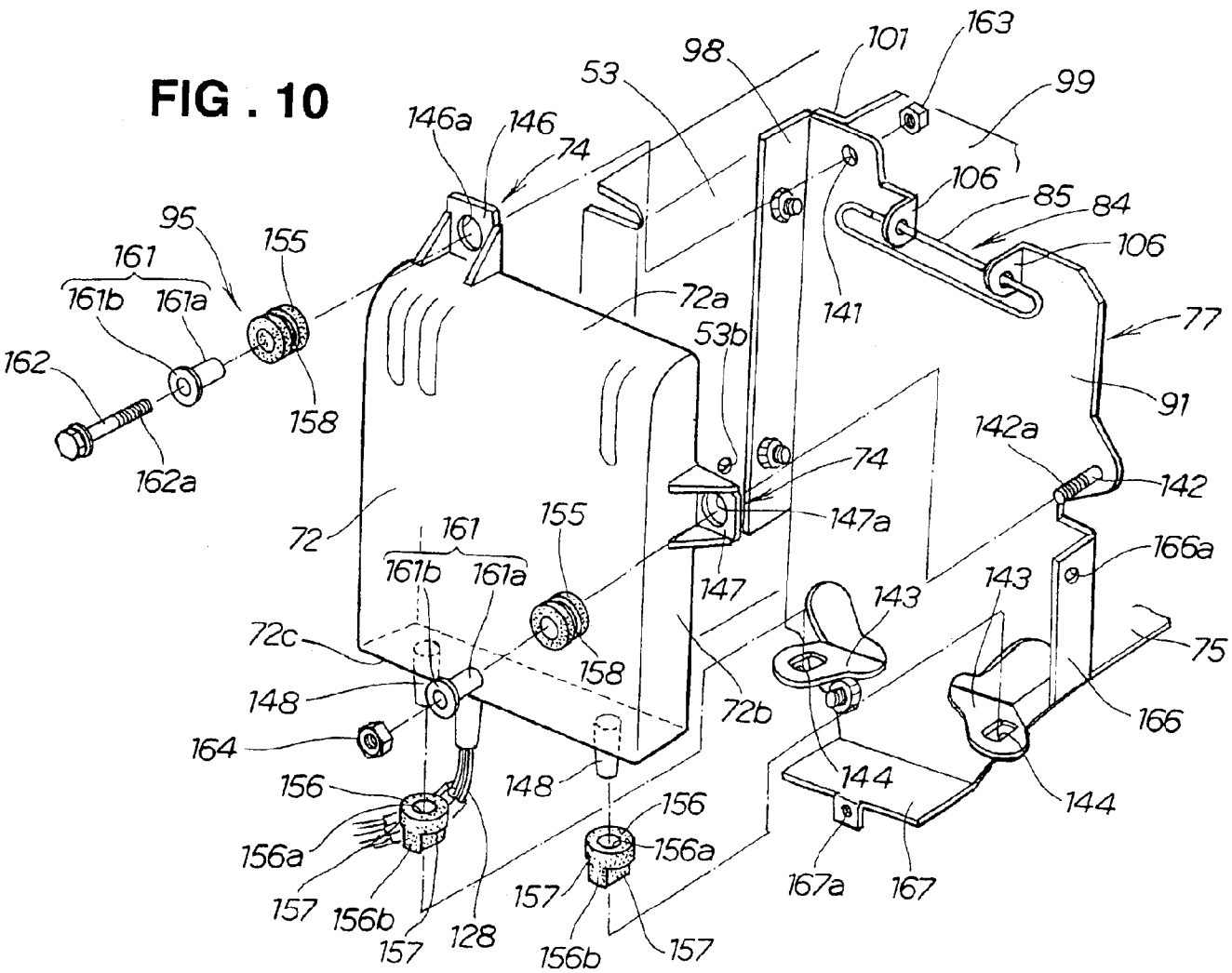
FIG. 10 is a perspective view showing the mounting of the control unit.

Referring to FIG. 10, the control unit 72 is attached to the right wall 91 of the battery holder 77 with the vibro-isolating members 95 (see FIG. 6) interposed therebetween. The vibro-isolating members 95 are vibration-absorbing members and include upper vibro-isolating materials 155, 155 and lower vibro-isolating materials 156, 156. The upper vibro-isolating materials 155, 155 and the lower vibro-isolating materials 156, 156 will be described in detail below.

For mounting the control unit 72 to the right wall 91, a mounting hole 141 is formed in an upper end portion of the right wall 91, a rightward-protruding bolt 142 is provided at a front end portion of the right wall 91, a pair of rightward-protruding supporting portions 143, 143 are provided near the lower end of the right wall 91, and insertion holes 144, 144 are formed in the supporting portions 143, 143, respectively.

The control unit 72 is formed in a substantially rectangular box shape and controls electrical components of the motorized snow removing machine 10 (see FIG. 1).

The motorized snow removing machine 10 means a snow removing machine designed such that the travel device 14 shown in FIG. 1 is driven by the left and right electric motors 12, 13.

The electrical components mean the left and right electric motors 12, 13 (see FIG. 1), the electromagnetic clutch 58 and the generator 68 (see FIG. 3), the relays 115 (see FIG. 6) and so on.

The control unit 72 has an upper mounting portion 146 protruded upward from an upper edge 72*a* and formed with a mounting hole 146*a*, and a front mounting portion 147 protruded forward from a front edge 72*b* and formed with a mounting hole 147*a*.

The upper mounting portion 146 attached to the upper edge 72*a* of the control unit 72 and the front mounting portion 147 attached to the front edge 72*b* constitute upper mounting members 74 of the control unit 72.

The control unit 72 also has a pair of protrusions 148, 148 protruding downward from its lower edge 72*c*, and the wire harness 128 connected to the lower edge 72*c*.

The pair of protrusions 148, 148 of the control unit 72 are fitted into through holes 156*a*, 156*a* of the lower vibro-isolating materials 156*a*, 156*a*, respectively.

The lower vibro-isolating materials 156 are formed in a substantially tubular shape, each having a pair of receiving surfaces 157, 157 formed to make its lower opposite sides a pair of steps. The lower vibro-isolating materials 156 are effective in preventing mainly vertical vibration to the control unit 72.

The pair of protrusions 148, 148 are fitted into the through holes 156*a*, 156*a* of the lower vibro-isolating materials 156, 156, and lower portions 156*b*, 156*b* of the lower vibro-isolating materials 156, 156 are inserted into the insertion holes 144, 144 of the supporting portions 143, 143, respectively. As a result, the receiving surfaces 157 of the lower vibro-isolating materials 156, 156 abut on the supporting portions 143, 143 of the battery holder 77.

One of the upper vibro-isolating materials 155 is fitted to the mounting hole 146*a* of the upper mounting portion 146 of the upper mounting members 74. The upper vibro-isolating material 155 formed in a substantially tubular shape has a circular groove 158 in the middle of its periphery, and is effective in preventing mainly horizontal vibration of the control unit 72.

The circular groove 158 of the upper vibro-isolating material 155 is engaged with a periphery of the upper mounting portion 146 forming the mounting hole 146*a*. A body 161*a* of a collar 161 is inserted into the upper vibro-isolating material 155 to cause a washer 161*b* of the collar 161 to abut on the upper vibro-isolating material 155.

A bolt 162 is inserted into the collar 161 to protrude a distal end portion 162*a* of the bolt 162 formed with a screw from the upper vibro-isolating material 155. The protruded distal end portion 162*a* of the bolt 162 is inserted into the mounting hole 141 of the right wall 91. A nut 163 is screwed onto the distal end portion 162*a* of the bolt 162 protruded from the mounting hole 141.

The other upper vibro-isolating material 155 is fitted to the front mounting portion 147 of the upper mounting members 74 in the same manner as to the mounting hole 146*a* of the upper mounting portion 146. Specifically, a circular groove 158 of the upper vibro-isolating material 155 is engaged with a periphery of the front mounting portion 147 forming the mounting hole 147*a*. A body 161*a* of a collar 161 is inserted into the upper vibro-isolating material 155 to cause a washer 161*b* of the collar 161 to abut on the upper vibro-isolating material 155.

The bolt 142 is inserted into the collar 161 to protrude a distal end portion 142*a* of the bolt 142 formed with a screw from the upper vibro-isolating material 155, and a nut 164 is screwed onto the protruded distal end portion 142*a*.

The wire harness 128 connected to the lower edge 72*c* of the control unit 72 is a bundle of the wire harnesses 71 of a bundle of the electric wires of the left and right electric motors 12, 13 shown in FIG. 1 and the electric wire of the electromagnetic clutch 58 (see FIG. 3), the electric wires 129 of the battery 51 shown in FIG. 6, the electric wire 127 (see FIG. 4) of the light 52 shown in FIG. 6, and electric wires connected to other electrical components such as the relays 115.

Figure 11:
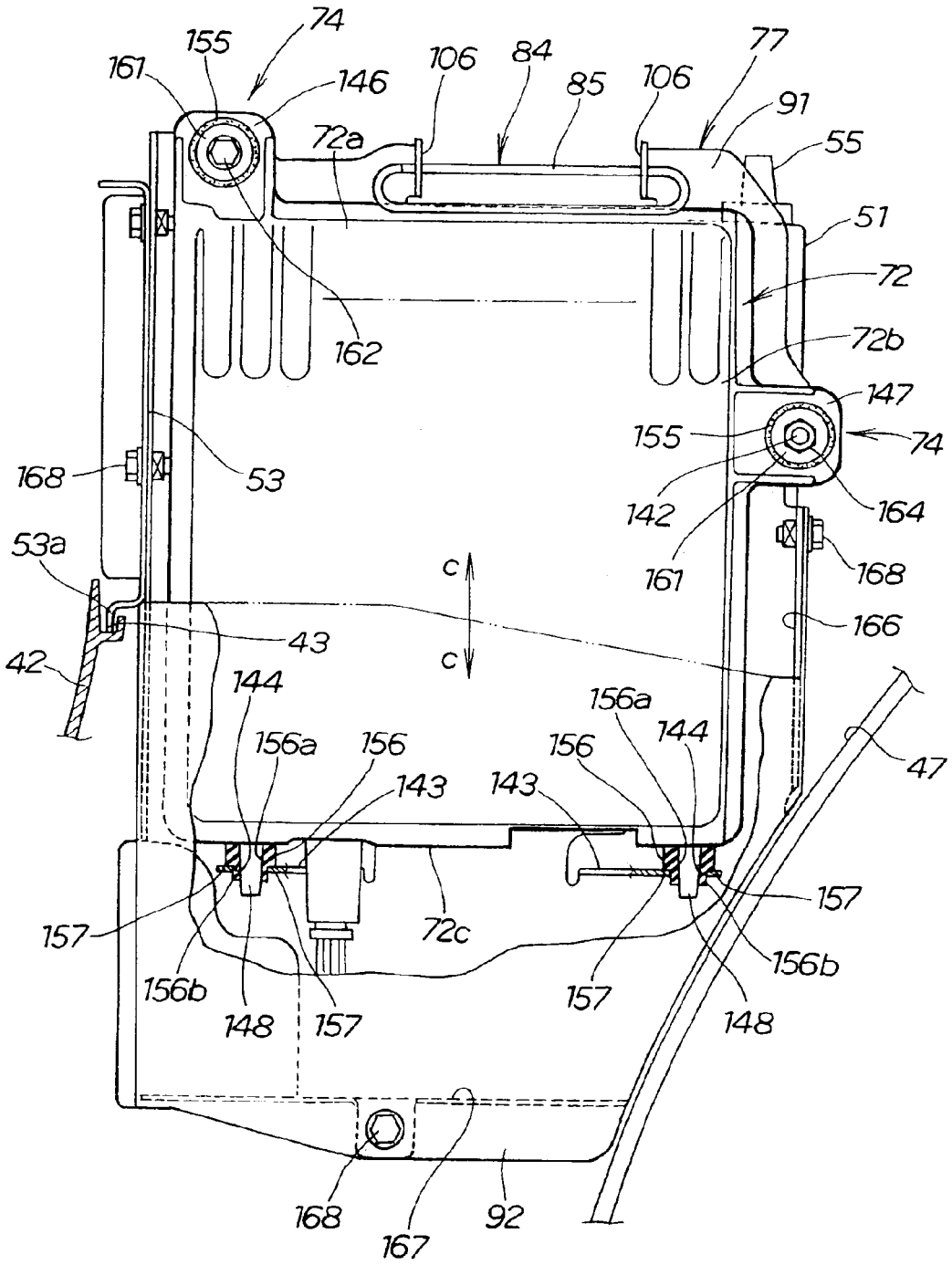
FIG. 11 is a side view of the control unit attached to a right wall of a battery holder.

As shown in FIG. 11, the pair of protrusions 148, 148 protruding from the lower edge 72*c* of the control unit 72 are fitted into the through holes 156*a*, 156*a* of the lower vibro-isolating materials 156, 156. The lower portions 156*b*, 156*b* of the lower vibro-isolating materials 156, 156 after the fitting are inserted into the insertion holes 144, 144 of the supporting portions 143, 143 to cause the receiving surfaces 157 of the lower vibro-isolating materials 156, 156 to abut on the supporting portions 143, 143.

The disposition of the lower vibro-isolating materials 156, 156 at the lower edge 72*c* of the control unit 72 effectively prevents mainly vertical (arrows c—c direction) vibration of vibration acting on the control unit 72. Specifically, the lower vibro-isolating materials 156 are interposed between the lower edge 72*c* of the control unit 72 and the supporting portions 143 to effectively absorb vertical vibration transmitted from the supporting portions 143 with the lower vibro-isolating materials 156. Also, the lower vibro-isolating materials 156 are interposed between the protrusions 148 and the supporting portions 143 to effectively absorb horizontal vibration transmitted from the supporting portions 143.

The upper mounting portion 146 of the control unit 72 is attached to the right wall 91 of the battery holder 77 with the bolt 162 with the upper vibro-isolating material 155 interposed therebetween. The front mounting portion 147 of the control unit 72 is attached to the right wall 91 of the battery holder 77 with the bolt 142 with the upper vibro-isolating material 155 interposed therebetween.

As shown in FIG. 6, the guard member 92 is attached to the right wall 91 of the battery holder 77.

The guard member 92 is fixed to the right wall 91 and the bulkhead 53 with a plurality of bolts 168 as shown in FIG. 11, using a mounting hole 166*a* formed in a front bent portion 166 of the right wall 91, a mounting hole 167*a* formed in a lower bent portion 167 of the right wall 91 and a mounting hole 53*b* formed in the bulkhead 53 as shown in FIG. 10.

After the lower vibro-isolating materials 156, 156 are inserted into the insertion holes 144, 144 of the supporting portions 143, 143, the upper mounting portion 146 and the front mounting portion 147 of the control unit 72 are attached to the right wall 91 of the battery holder 77 with the bolts 162, 142 with the upper vibro-isolating materials 155, 155 interposed therebetween. Thus, the control unit 72 can be easily attached to the right wall 91.

Figure 12:
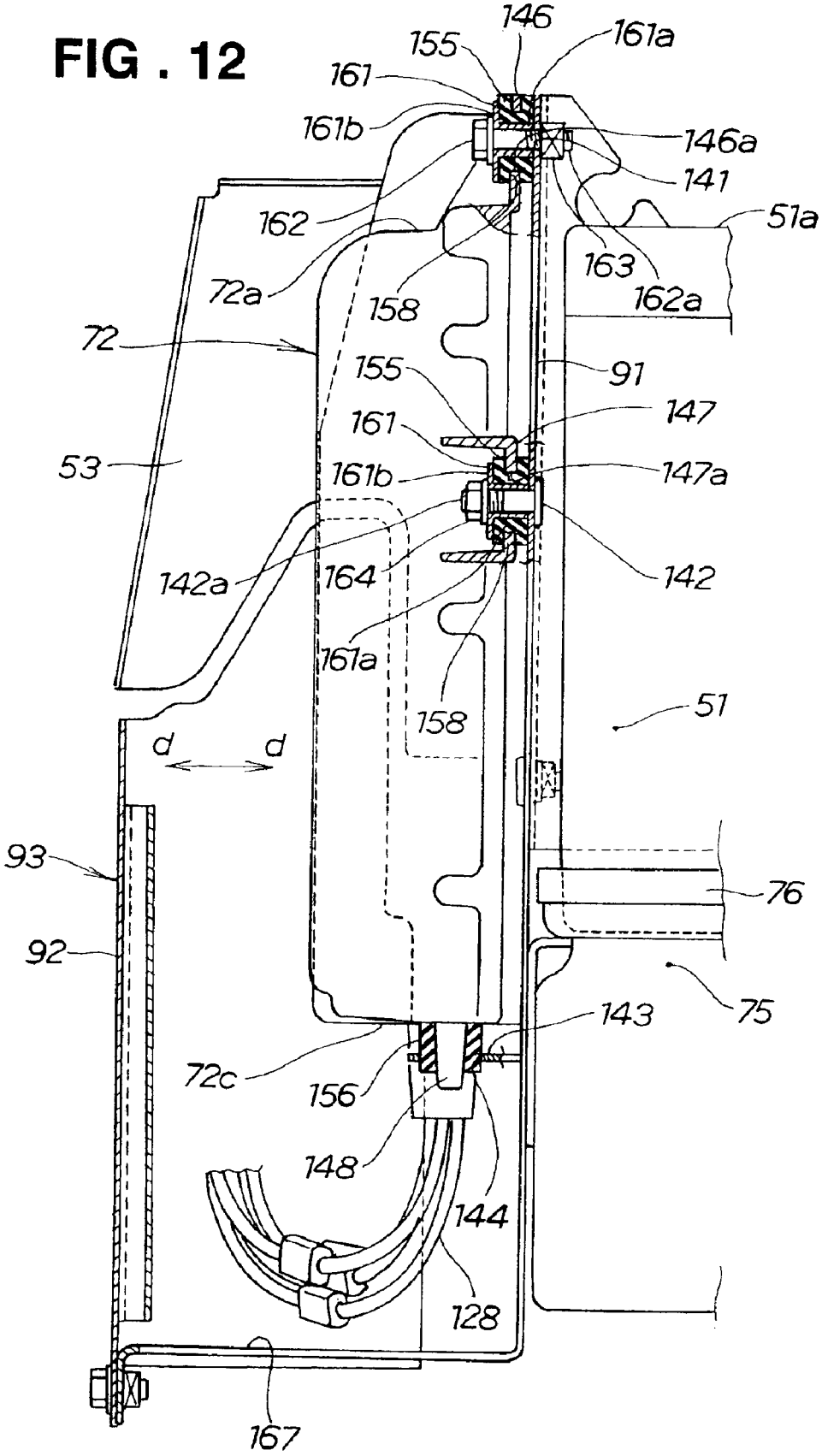
FIG. 12 is a front view of the control unit attached to the right wall of the battery holder with vibro-isolating members shown in cross section interposed therebetween.

As shown in FIG. 12, since the upper mounting portion 146 and the front mounting portion 147 of the control unit 72 (i.e., the upper mounting members 74 of the control unit 72) are attached to the right wall 91 with the upper vibro-isolating materials 155, 155 interposed therebetween, mainly lateral (arrows d—d direction) vibration of vibration acting on the control unit 72 is effectively absorbed. Specifically, the upper mounting portion 146 is attached to the right wall 91 with the upper vibro-isolating material 155 interposed therebetween to be distanced from the right wall 91 and the washer 161*b* of the collar 161, so that horizontal vibration from the right wall 91 and the washer 161*b* of the collar 161 is not transmitted to the control unit 72

Since the upper vibro-isolating material 155 is interposed between the body 161*a* of the collar 161 and the periphery of the mounting hole 146*a* of the upper mounting portion 146, vertical vibration transmitted from the body 161*a* of the collar 161 is also prevented.

Likewise, the front mounting portion 147 is attached to the right wall 91 with the upper vibro-isolating material 155 interposed therebetween to be distanced from the right wall 91 and the washer 161*b* of the collar 161, so that horizontal vibration from the right wall 91 and the washer 161*b* of the collar 161 is not transmitted to the control unit 72

Since the upper vibro-isolating material 155 is interposed between the body 161*a* of the collar 161 and the periphery of the mounting hole 147*a* of the front mounting portion 147, vertical vibration transmitted from the body 161*a* of the collar 161 is also prevented.

The wire harness 128 connected to the lower edge 72*c* of the control unit 72 is enclosed by the guard member 92 and the lower bent portion 167 of the right wall 91, so that the wire harness 128 is protected from rain and snow.

Figure 13:
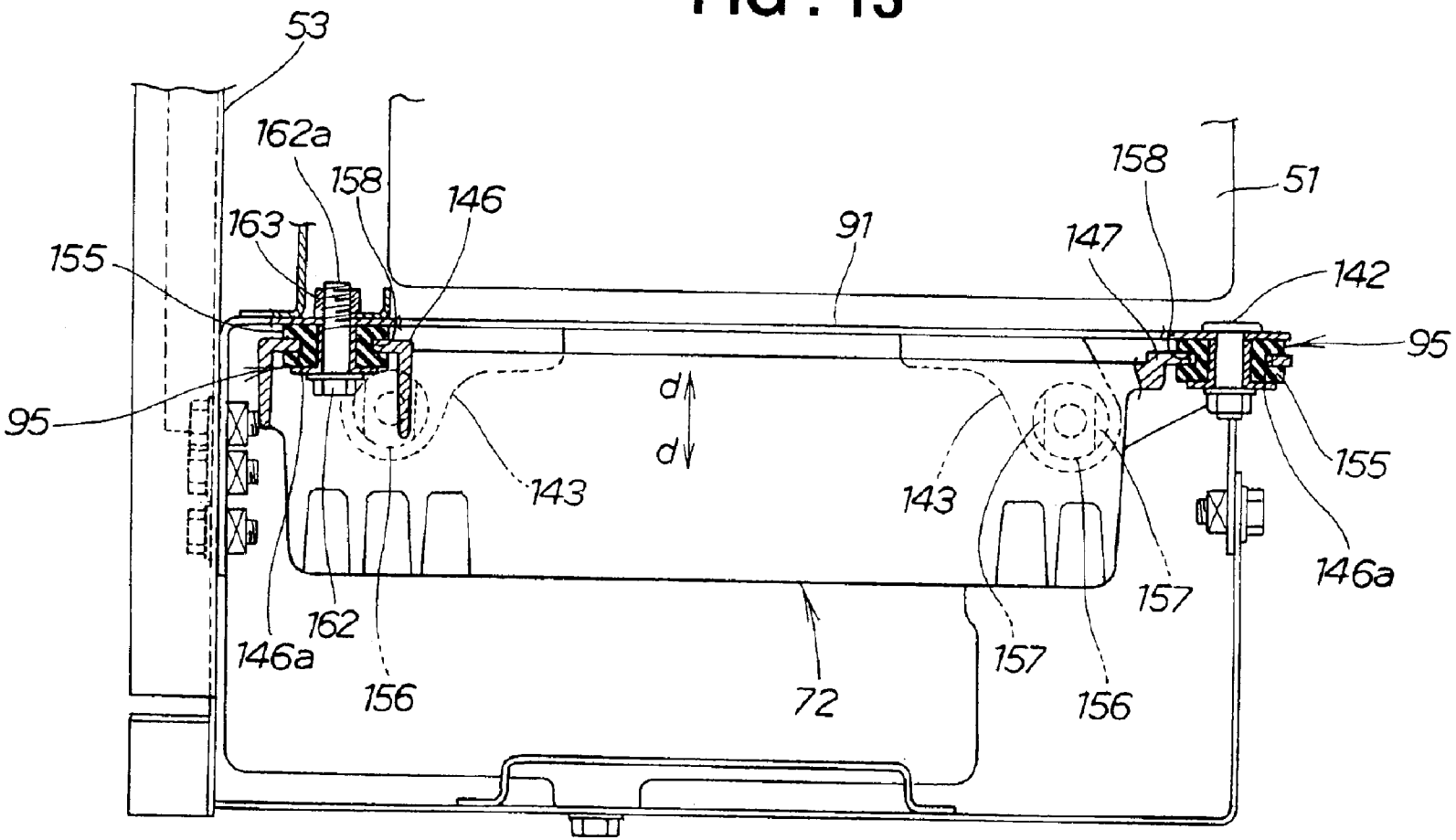
FIG. 13 is a plan view of the control unit shown in FIG. 12 with upper vibro-isolating materials shown in cross section.

Referring to FIG. 13, the upper mounting portion 146 and the front mounting portion 147 of the control unit 72 are attached to the right wall 91 with the pair of upper vibro-isolating materials 155, 155 interposed therebetween. As a result, the pair of upper vibro-isolating materials 155, 155 prevent mainly horizontal (arrows d—d direction) vibration. The vibro-isolating members 95, i.e., the upper vibro-isolating materials 155, 155 and the lower vibro-isolating materials 156, 156 damp vibration transmitted from the transmission case 11 (see FIG. 1) to the control unit 72.

Although the embodiment has been described with an example of providing the chute 37 on an upper left portion of the blower housing 44 and disposing the battery 51 and the control unit 72 on the right of the chute 37, the present invention is not limited thereto. It is alternatively possible to provide the chute 37 on an upper right portion of the blower housing 44 and dispose the battery 51 and the control unit 72 on the left of the chute 37.

The shapes of the battery 51 and the control unit 72 are not limited to those described in the embodiment, and other shapes may be applicable.

Obviously, various minor changes and modifications of the present invention are possible in the light of the above teaching. It is therefore to be understood that within the scope of the appended claims the invention may be practiced otherwise than as specifically described.

What is claimed is:

1. A snow removing machine comprising:

a body;

an engine mounted on the body;

a snow removing device including a blower housing disposed at the front of the body and a blower mounted within the blower housing and driven by the engine;

a chute mounted on and extending upwardly from the blower housing;

a battery for supplying power to electric motors for driving travel units disposed at the right and left of the body; and a control unit for controlling rotations of the electric motors;

wherein the battery and the control unit are disposed on the blower housing and located next to the chute in a widthwise direction of the snow removing machine; and wherein the chute is disposed forwardly of the engine and located on one of a right side or left side of the blower housing, and the battery and the control unit are disposed on the other of the right side or the left side of the blower housing.

2. A snow removing machine as set forth in claim 1, wherein the battery is provided next to the chute, and the control unit provided next to the battery.

3. A snow removing machine as set forth in claim 1, wherein the control unit is mounted on the blower housing with vibro-isolating members interposed therebetween, and the vibro-isolating members comprise lower vibro-isolating materials provided at a lower portion of the control unit for preventing mainly vertical vibration of the control unit, and upper vibro-isolating materials provided at an upper portion of the control unit for preventing mainly horizontal vibration of the control unit.

4. A snow removing machine as set forth in claim 1, wherein the control unit is mounted on the blower housing with vibro-isolating members interposed therebetween, the vibro-isolating members having a tubular shape and a central axis lying in a vertical plane or a horizontal plane.

5. A snow removing machine comprising: a body; travel units disposed at opposite sides of the body for transporting the snow removing machine along the ground; electric motors connected to drive the travel units; a battery for supplying power to the electric motors; a control unit for controlling operation of the electric motors; a snow removing device disposed at a front portion of the body for removing snow; and a chute connected to the snow removing device for discharging snow removed by the snow removing device; wherein the chute and the control unit are laterally spaced apart from one another along a widthwise axis of the snow removing machine and extending between the travel units, the battery being interposed between the chute and the control unit.

6. A snow removing machine according to claim 5; wherein the battery is disposed along the widthwise axis in between the chute and the control unit.

7. A snow removing machine according to claim 5; wherein the snow removing device includes a blower housing disposed at the front of the body, and a blower mounted within the blower housing; and wherein the chute, control unit and battery are all disposed on the blower housing.

8. A snow removing machine according to claim 7; further comprising an engine mounted on the body and connected to drive the blower; and wherein the chute, control unit and battery are all located forwardly of the engine.

9. A snow removing machine according to claim 7; further including vibration-absorbing members interposed between the control unit and the blower housing for preventing vibration of the control unit during operation of the snow removing machine.

10. A snow removing machine according to claim 9; wherein the vibration-absorbing members have a tubular shape and are positioned such that a central axis of each tubular-shaped member extends in a vertical direction or a horizontal direction.

* * * * *